US007954214B2

(12) United States Patent
Münster et al.

(10) Patent No.: US 7,954,214 B2
(45) Date of Patent: Jun. 7, 2011

(54) TRANSPORT CART FOR NEEDLE BOARDS

(75) Inventors: Bernhard Münster, Messstetten (DE); Franz Jerger, Albstadt (DE); Thomas Maier, Albstadt (DE); Zl'atan Medugorac, Ulm (DE)

(73) Assignee: Groz-Beckert KG, Albstadt (DE)

( * ) Notice: Subject to any disclaimer, the term of this patent is extended or adjusted under 35 U.S.C. 154(b) by 399 days.

(21) Appl. No.: 12/232,127

(22) Filed: Sep. 11, 2008

(65) Prior Publication Data

US 2009/0064475 A1 Mar. 12, 2009

(30) Foreign Application Priority Data

Sep. 12, 2007 (EP) ..... 07017873

(51) Int. Cl.
*D04H 18/00* (2006.01)

(52) U.S. Cl. ..... 28/107; 28/115

(58) Field of Classification Search ..... 28/107, 28/115, 108–114; 414/332, 426, 428, 429, 414/458, 331.06, 331.14
See application file for complete search history.

(56) References Cited

U.S. PATENT DOCUMENTS

| | | | | |
|---|---|---|---|---|
| 2,706,056 | A * | 4/1955 | Talley et al. | 414/458 |
| 3,486,650 | A * | 12/1969 | Boone | 414/458 |
| 3,574,907 | A * | 4/1971 | Agache et al. | 28/172.1 |
| 4,512,473 | A * | 4/1985 | Thomaswick et al. | 206/454 |
| 5,018,930 | A * | 5/1991 | Hardin et al. | 414/458 |
| 5,287,604 | A | 2/1994 | Feyerl | |
| 5,699,595 | A | 12/1997 | Feyerl | |
| 6,003,215 | A * | 12/1999 | St. Jacques | 28/115 |
| 6,145,176 | A * | 11/2000 | Egnaczak et al. | 28/107 |
| 6,186,728 | B1 * | 2/2001 | Michaud | 414/458 |
| 6,195,855 | B1 | 3/2001 | Feyerl | |
| 6,314,628 | B1 * | 11/2001 | Crook | 28/208 |

FOREIGN PATENT DOCUMENTS

| | | |
|---|---|---|
| DE | 39 41 159 | 6/1990 |
| DE | 42 24 038 | 2/1993 |
| DE | 100 21 547 | 12/2000 |
| JP | 2000110061 | 4/2000 |
| JP | 2003020556 | 1/2003 |

* cited by examiner

*Primary Examiner* — Amy B Vanatta
(74) *Attorney, Agent, or Firm* — Fitch, Even, Tabin & Flannery; Norman N. Kunitz

(57) ABSTRACT

A transport cart (1) for needle boards (2) in accordance with the invention is provided with an accommodation device (8) that is designed so that its height can be adjusted and that it can also be pivoted about at least one axis, and that it is associated with a protective cover which can be moved together with the accommodation device. Numerous adjustment options, guide and stop devices are provided in order to be able to also handle large and heavy needle boards in a safe and careful manner.

10 Claims, 7 Drawing Sheets

TRANSPORT CART FOR NEEDLE BOARDS

CROSS-REFERENCE TO RELATED APPLICATION

The present application claims the priority of European Patent Application No. 07 017 873.6, filed Sep. 12, 2007, the subject matter of which, in its entirety, is incorporated herein by reference.

BACKGROUND OF THE INVENTION

The invention relates to a transport cart for transporting and handling needle boards as are used in felting machines.

Felting machines comprising needle boards are used in felt production. Such a needle board is a large plate-shaped component which is provided with a plurality of felting needles that project from one surface of this plate. While one or more such needle boards are used in a felting machine, in most cases, a large number of needle boards is kept readily available at a storage site for installation in the felting machine and removal therefrom when necessary. Felting needles are wearing parts. Therefore, they must be replaced now and then. This is done with appropriate automatic loaders into which the needle boards are to be transferred and from which the needle boards are to be removed as needed. The needle boards may have a significant weight of several kilograms, e.g., 50 kg and more, and have a large size. One the one hand, the felting needles are relatively sensitive and must not be damaged during transport or during storage. Even a minimal bending of one or more of the felting needles is unacceptable. On the other hand, the felting needles frequently have a very sharp tip, sharp edge and/or are provided with barbs, so that they pose a significant risk of injury.

It is the object of the invention to provide a possibility for a careful and hazard-free transport of the needle boards.

SUMMARY OF THE INVENTION

The above object is generally achieved with the transport cart in accordance with the invention that comprises a base frame with running wheels, so that the cart may be moved on a factory floor, either manually or, optionally, also by means of an attached or integrated driving device. Preferably, the running wheels are free-running. One or more of them may also be assigned driving devices, braking devices or the like.

The base frame of the transport cart supports an accommodation device for a needle bed. This accommodation device has comprises at least one accommodation element adapted to the edge of the needle board and at least one locking device for securing the needle board in the accommodation device. This makes it possible that the needle board is only grasped by its edges and that the surface, from which the plurality of felting needles extends, is not touched. Consequently, the accommodation device is already set up to grasp and hold the needle board along its edge. Furthermore, the accommodation device comprises a locking means that is disposed to secure the needle board in an accommodation position. In so doing, a needle board can be picked up, for example, at a storage site and rolled from there to an automatic loader or a felting machine, without the risk of damaging the board or of injuring people. Likewise, the needle board may be accommodated on an automatic loader or a felting machine in order to be rolled to another site.

Preferably, the accommodation device is supported by the base frame so as to be adjustable in at least one direction. This direction is the vertical direction, for example. This facilitates the transfer of the needle board to a felting machine or to an automatic loader. The height of the accommodation device is simply adjusted to the height at which the needle board is to be set in the automatic loader or in the felting machine and then transferred along a horizontal path from the accommodation device into the felting machine or the automatic loader. This facilitates the work of the operator, in particular when the needle board is very heavy. A hydraulic lifting device, a spindle-type lifting gear-system or the like with a manual or a motor drive may be used.

Preferably, the accommodation device is supported so as to be pivotable about at least one axis relative to the base frame. Preferably, this axis is a horizontal axis that is oriented in a direction transverse to the long edges of the needle board and preferably approximately parallel to the short edges of the needle board. In this manner, a needle board received by the accommodation device and having, for example, a length of 2 meters, can be pivoted into a vertical position in order to allow for easy transport. In so doing, the transport is possible even if confined spatial conditions exist at the site of use.

Preferably, the accommodation device is supported so as to be pivotable about at least a second axis, which may also be referred to as the tilt axis. This tilt axis is oriented preferably parallel to a long edge of the needle board and thus in a direction transverse—preferably at a right angle—to the first axis. Preferably, the second pivot axis extends near the accommodation element, i.e., near a long edge of the needle board. In so doing, the needle board can be moved into a vertical position or even into an inclined position, in which said board can be moved into an automatic loader, for example.

Preferably, at least one actuation device is provided which can be used to pivot the accommodation device in a targeted manner about the first and/or the second axis. Preferably, the actuation device is a manually actuated device; however, it is also possible to provide a motor drive. Preferably, the actuation device is self-locking, i.e., it holds the accommodation device—largely independently of the forces acting on the accommodation device—in the once-set position. For example, the actuation device comprises a worm gear or another self-locking gear that is used to transmit the force from the actuation member, for example, a hand-wheel, to the accommodation device.

Preferably, an actuation device is provided which, when actuated, effects a pivoting movement of the accommodation device about the first axis, as well as about the second axis. As a result of this, the needle board can be pivoted—by actuating a single actuation device—out of the accommodation position into a transport position. In the accommodation position, the needle board is held horizontally, for example, whereas in a transport position, said board is held vertically. In other words, the transport cart has an adjustment device which can be used to adjust the accommodation device between a preferably selectable accommodation position for the needle board and a transport position for the needle board. The accommodation position differs from the transport position preferably by a rotation of 90° about at least one of the two axes. While the needle board may be received and delivered lying flat, it is transported in upright position.

The accommodation element, for example, is a first profile rail, that docks, e.g., at one of the long edges of the needle board, preferably only in the center section thereof. The accommodation means comprises, in addition to the accommodation element, i.e., for example the profile rails, the locking means that may also be configured as a profile rail. This second profile rail also grasps the needle board, preferably along its long edge. Preferably, the distance of the second profile rail from the first profile rail is adjustable in order to permit an adaptation to various needle bed widths. Furthermore, the second profile rail is preferably supported so as to be pivotable and adjustable between a holding position and a release position. Preferably, said rail can be locked in both positions. The second profile rail is preferably pivoted between the holding position and the release position about a pivot axis that is parallel to the long edge of the needle board. As a result of this, the needle board can be moved parallel to its long edges, as well as, optionally, also transversely with respect to said edges, into the accommodation device and out of the accommodation device.

The locking means are preferably located on a short edge and/or on a corner of the needle board. For example, the locking means consist of movably supported locking members configured, for example, like engagement-type means, that are supported by telescopable arms that extend away from the accommodation device. The locking members may be supported so as to be movable perpendicularly to the flat side of the needle board and be spring-biased in their locking position. If the locking members have—on their side facing the needle board—a locking surface positioned transversely to the sliding direction of the needle board and—on their side facing away from the needle board—an inclined surface, they can, if the needle board is to be moved into the accommodation device parallel to the longitudinal edge, be displaced by the needle board, in which case said locking members will then engage behind the needle board thus locking it in place.

Additional details of advantageous embodiments are obvious from the claims, the drawings or the description. The description is essentially restricted to essential aspects of the invention and miscellaneous situations. The drawings disclose additional details and supplement the description.

DETAILED DESCRIPTION OF THE INVENTION

Figure 1:
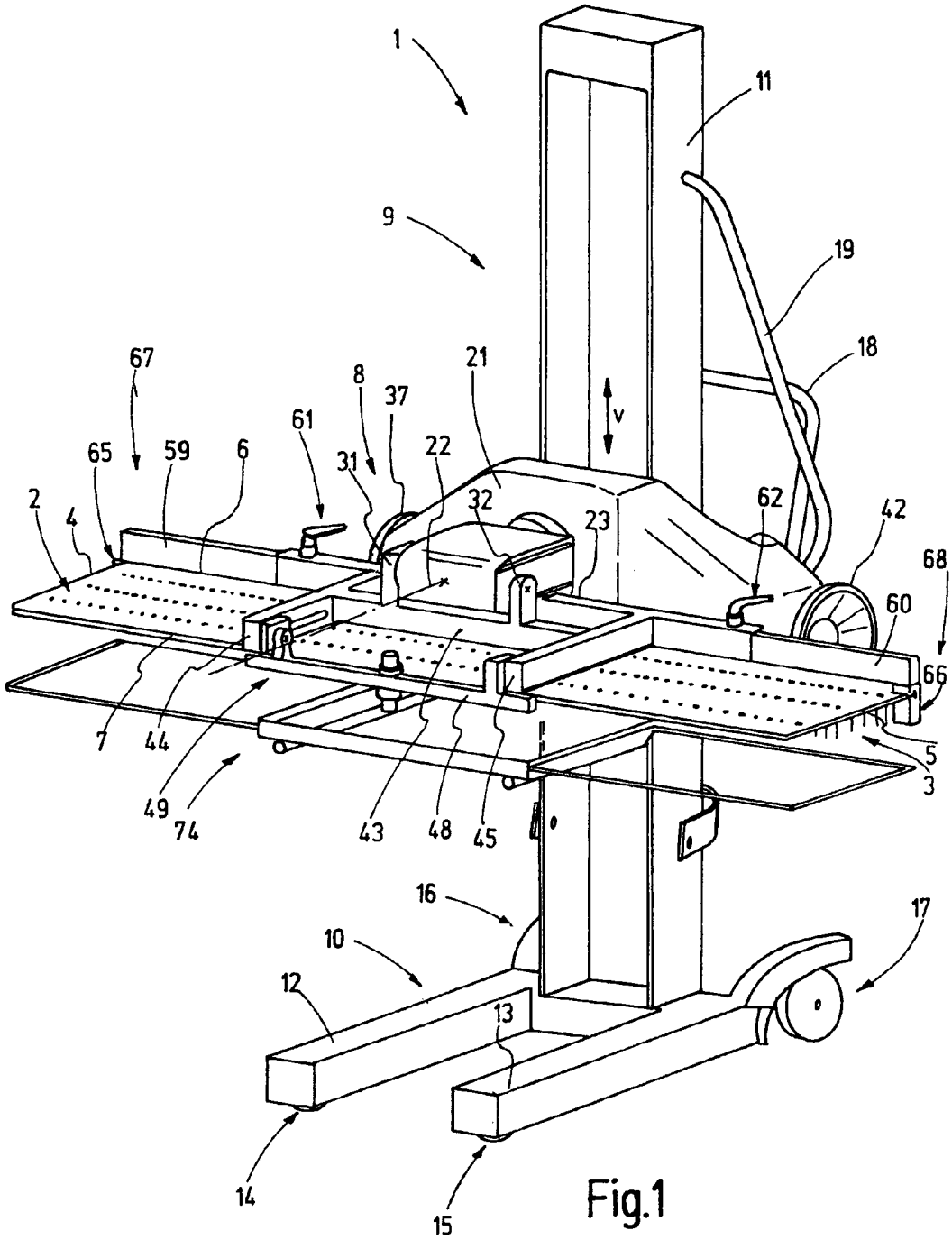
FIG. 1 is a perspective general view of the transport cart in accordance with the invention, wherein the cart's accommodation device is in a first horizontal position.

FIG. 1 shows a transport cart 1 for at least one needle board 2. The needle board 2 is a plate-shaped body with a plurality of felting needles 2 that essentially extend at a right angle from the flat side of the needle board 2 and are held on the needle board 2. The needle board 2 has a rectangular contour with two short edges 4, 5 and two long edges 6, 7. It is held in an accommodation device 8 that, in turn, is held by a base frame 9 of the transport cart 1. This cart has a foot 10 from which extends, in vertical direction, a column 11. The foot 10 has, e.g., two spaced apart side rails 12, 13 that are provided on their free ends with rollers 14, 15 or, instead, with adjustable feet. On their other ends, the side rails 12, 13 are connected to each other and also provided with rollers 16, 17. For moving the transport cart 1, one or more handles 18, 19, 20 are provided, as is obvious from FIG. 2.

Figure 8:
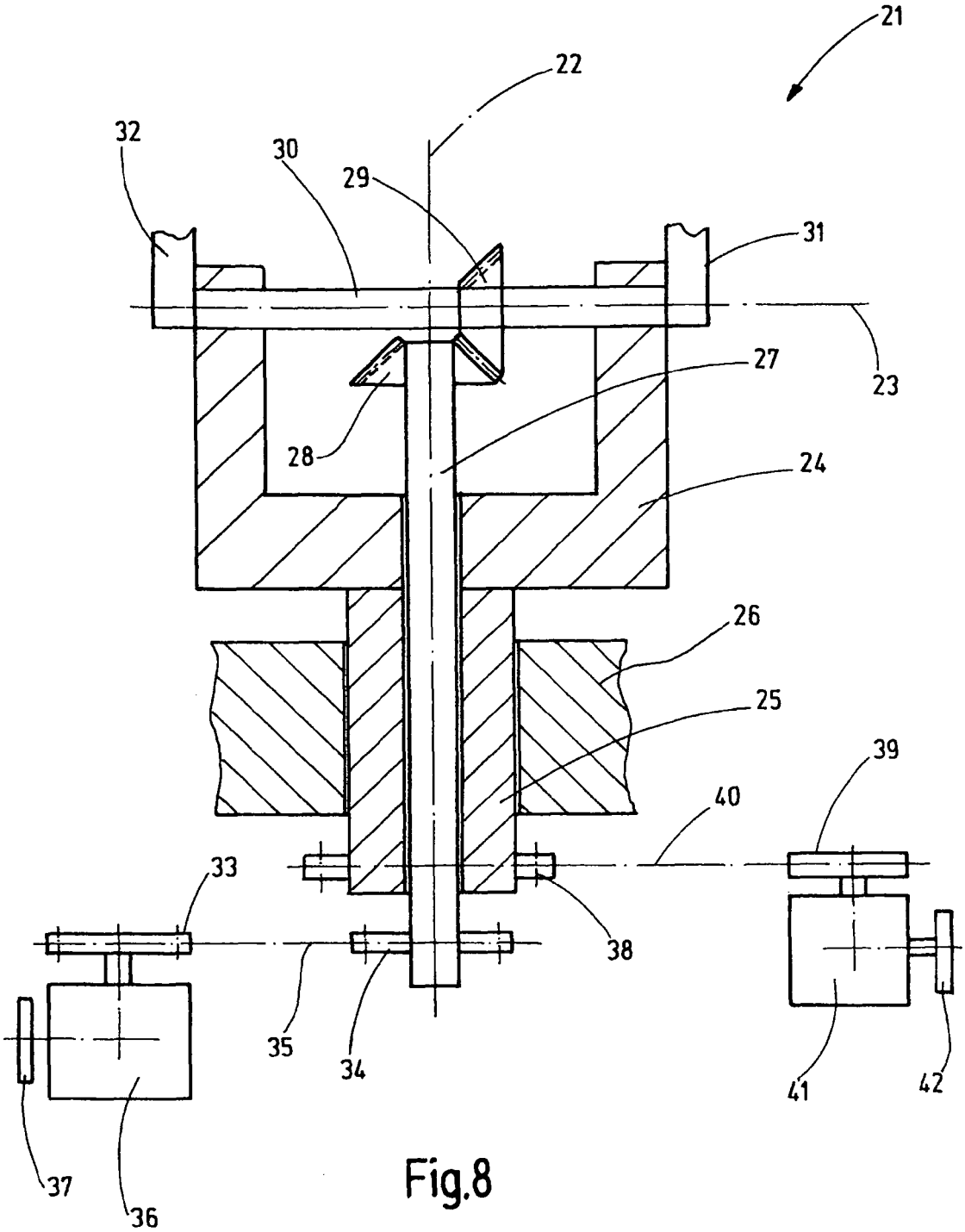
FIG. 8 is a schematic view of the principle of the actuation device for pivoting the accommodation device.

The accommodation device 8 is mounted to the column 11 at a fixed height or, as is preferred, in a vertically adjustable manner (arrow V, FIG. 1). The associate adjustment mechanism is not specifically shown. Between the column 11 and the actual accommodation device 8, there is an adjustment mechanism 21 that is shown closed in FIG. 1 and with the hood removed in FIG. 2. The adjustment mechanism 21 permits an adjustment of the accommodation device 8 about at least one, preferably two, axes 22, 23 (FIG. 1). The axis 22 preferably extends approximately parallel to the short edges 4, 5 and is oriented in horizontal direction. This axis is also referred to as the pivot axis. The axis 23 is preferably horizontal and parallel to the long edges 6, 7 of the needle board 2. This axis is also referred to as the tilt axis. The associate adjustment device 21 is shown schematically in FIG. 8. The latter device comprises a support 24 that is held on a hollow shaft 25. This hollow shaft is rotatably supported in a support element 26. The support element 26 is directly or also indirectly connected to column 11. A shaft 27 extends through the hollow shaft 25, said latter shaft bearing a bevel gear 28 on its one end in an intermediate space of the forked support 24. This bevel gear meshes with another bevel gear 29 that is stationarily connected to a shaft 30. The shaft 30 is arranged concentrically with respect to the axis 23 and is supported on both ends so as to be rotatable in the support 24. The shaft 27 is arranged concentrically to the axis 22 and is supported so as to be rotatable in the hollow shaft 25. The shaft 30 is non-torsionally connected to the arms 31, 32 that support the holding device 8.

The end of the shaft 27 that is remote from the bevel gear 28 is connected to a gear drive 36 by means of suitable gear means, for example, chain wheels 33, 34, and a chain 35, whereby said gear drive has an input shaft bearing a hand wheel 37. The gear drive 36 is preferably a self-locking gear, for example a worm gear.

The end of the hollow shaft 25 adjacent to the chain wheel 34 is also connected to a gear drive 41 via a gear means, for example two chain wheels 38, 39, and a chain 40, said gear drive's input shaft bearing a hand wheel 42. The gear drive 41 is preferably a self-inhibiting gear drive, for example a worm gear. Overall, the gearing reduction from the respective actuation device, the hand wheel 37, 42, to the respective output in the form of the support 24 or the arms 31, 32, is preferably equal to 20. Instead of the gear means with the worm gear, the chain wheel gear drive and the roller chain, it is also possible to use other means such as cogged gear drives, cogged belts, jointed shafts, lever drivers or a combination of these transmission means.

The accommodation device 8 comprises a frame 43 that has two parallel support arms 44, 45 extending in a direction transverse to the second axis 23. These arms are provided, on their side facing the needle board 2, for example with friction-reducing plastic coatings. The frame 43 supports an accommodation element 46 that is configured, as in FIGS. 2 through 6, as a profile rail 47, for example, said rail extending parallel to the long edge 6 and thus parallel to the second axis 23. The profile rail 47 is adapted to the edge or to the shape of the edge 6 of the needle board 2. Said rail extends over the edge of the needle board 2, whereby sufficient play is provided inside the profile rail 47 so that said needle board can be shifted parallel to said rail.

Opposite the profile rail 47 is an accommodation element in the form of a profile rail 48 that may act as a locking means 49 in order to hold and secure the needle board 2 in place in the accommodation device 8. The profile rail 48 is preferably supported so as to be pivotable about an axis 50 that is oriented parallel to the edge 7 of the needle board and thus parallel to the profile rails 47, 48. As is illustrated by an arrow in FIG. 6, the profile rail 48 can thus be pivoted between a holding position in accordance with FIG. 3 and a release position in accordance with FIG. 4. Preferably, said rail may be locked in both pivoting positions. To achieve this, e.g., a locking device 51 is provided. Respectively one lock pin 54, 55 is located in the two legs 52, 53 of the profile rail 48, said pins being movable in their longitudinal direction. The legs 52, 53 are supported on the accommodation devices 56, 57 that are provided with bores that are disposed for the engagement of the lock pins 54, 55. As a result of this, the profile rail 48 acting as the front clamp bar is fixed in place. The location of the bores prespecifies the two positions: "holding position" or "locked position" and "release position" or "open position". The two lock pins 54, 55 are connected to each other by a central rotary knob 58 via two rods. One rotary knob 58, respectively, is provided on each end of a shaft. As a result of this, said knob is accessible from two sides, thus facilitating operation. The rotary knob 58 is held by spring force in an angle position in which the lock pins 54, 55 extend into their bores. By rotating the rotary knob by 90°, the two rods retract the two lock pins 54, 55 from the bores, and the profile rail 48 may be pivoted. The angle of rotation of the rotary knob 58 is limited by appropriate stops.

Figure 6:
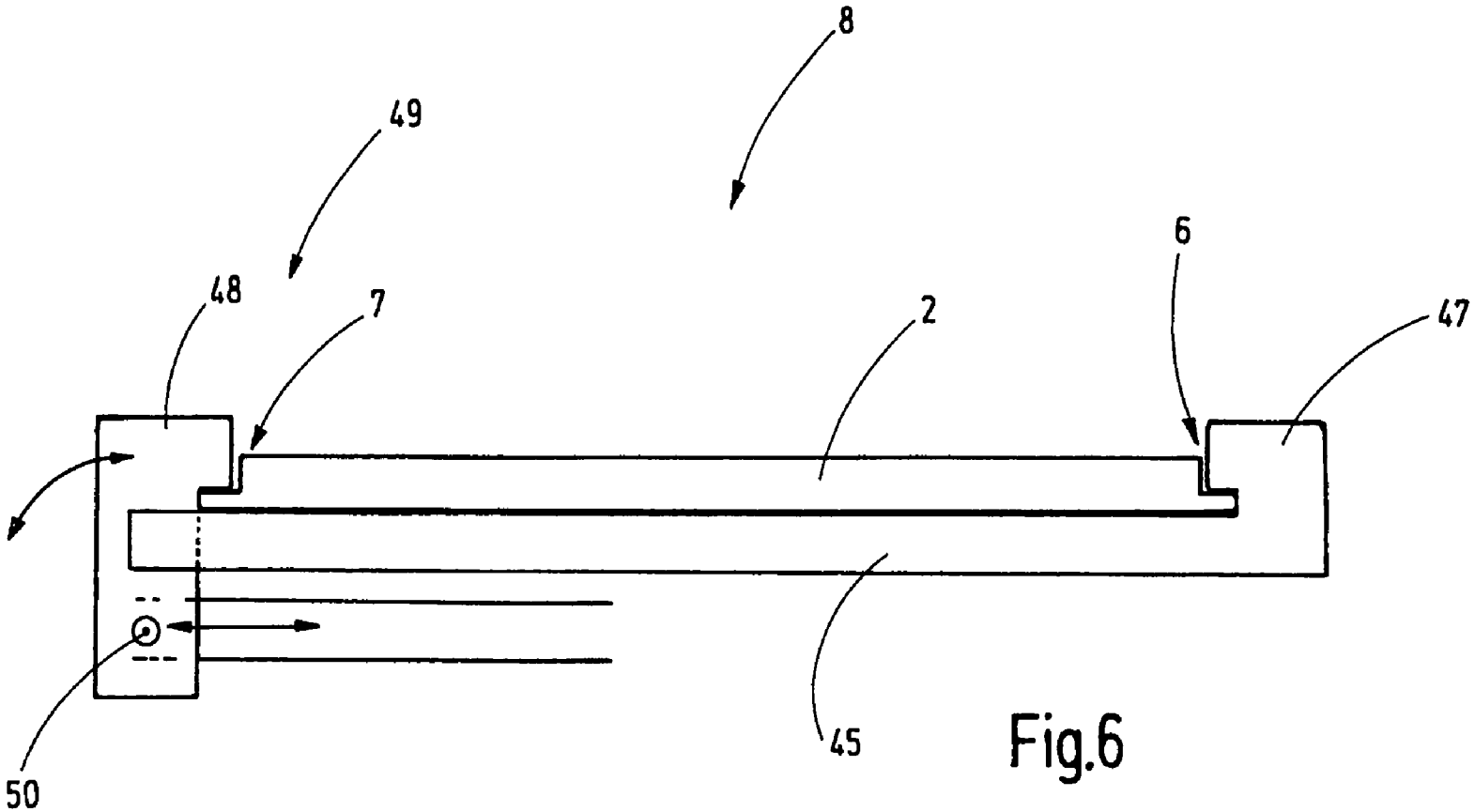
FIG. 6 is a fragmentary sketch-like side view of the accommodation device.

The accommodation elements 46, 47 are held on the arms 44, 45 so as to be adjustable relative to their longitudinal direction (see the arrow in FIG. 6). As a result of this linear adjustment, the distance between the profile rails 47, 48 may be set as desired and thus be adapted to needle boards 2 having different widths.

Extending from the frame 43 in opposite direction away from each other, preferably parallel to the long edge 6 of the needle board 2, are telescopable arms 59, 60 (FIG. 1). The arms 60 can be fixed in their respective adjustment positions by manually actuatable clamping levers 61, 62. The mirror-symmetrical scales 63, 64 (FIG. 2) on the upper side of the arms 59, 60 show the set length of the arms 59, 60 that corresponds to a specific length of the needle board 2. The reading edge is formed by the rim of the opening of the frame 43, into which opening the respective arm 59, 60 is to be inserted. Preferably, the scale is dimensioned in such a manner that, when the same values are set for the two arms 59, 60, the needle board 2 is seated so as to be centered in the accommodation device 8.

On their ends, the arms 59, 60 have stop units 65 66, each representing a locking means 67, 68. This locking means docks at the corners or the short edges 4, 5 of the needle board 2 and acts as a longitudinal stop for the needle board 2. The stop unit 65 is shown as such in FIGS. 7*a* through 7*d*. It comprises a guide body 69, in which a locking member configured as a locking bolt 70 is supported transversely with respect to the insertion direction (indicated by arrow 71) of the needle board 2 so as to be movable. The locking bolt 70 is biased in its locked positioned by a spring means 72. The locking bolt 70 is preferably essentially cylindrical, whereby it may be provided with an inclined surface 73 on its side facing outward against the insertion direction.

The frame 43 is provided with a protective cover 74 that is attached and held parallel to the needle board 2. As is obvious from FIG. 2, said cover is held by two bent tubes 75, 76 the ends of which are fastened to the frame 43. The protective cover 74 protects the needle board 2 from damage. In particular, the tips of the felting needles are protected against damage. In addition, the protective cover 74 provides a safety guard for people. People are prevented from inadvertently reaching into the tips of the felting needles.

Figure 2:
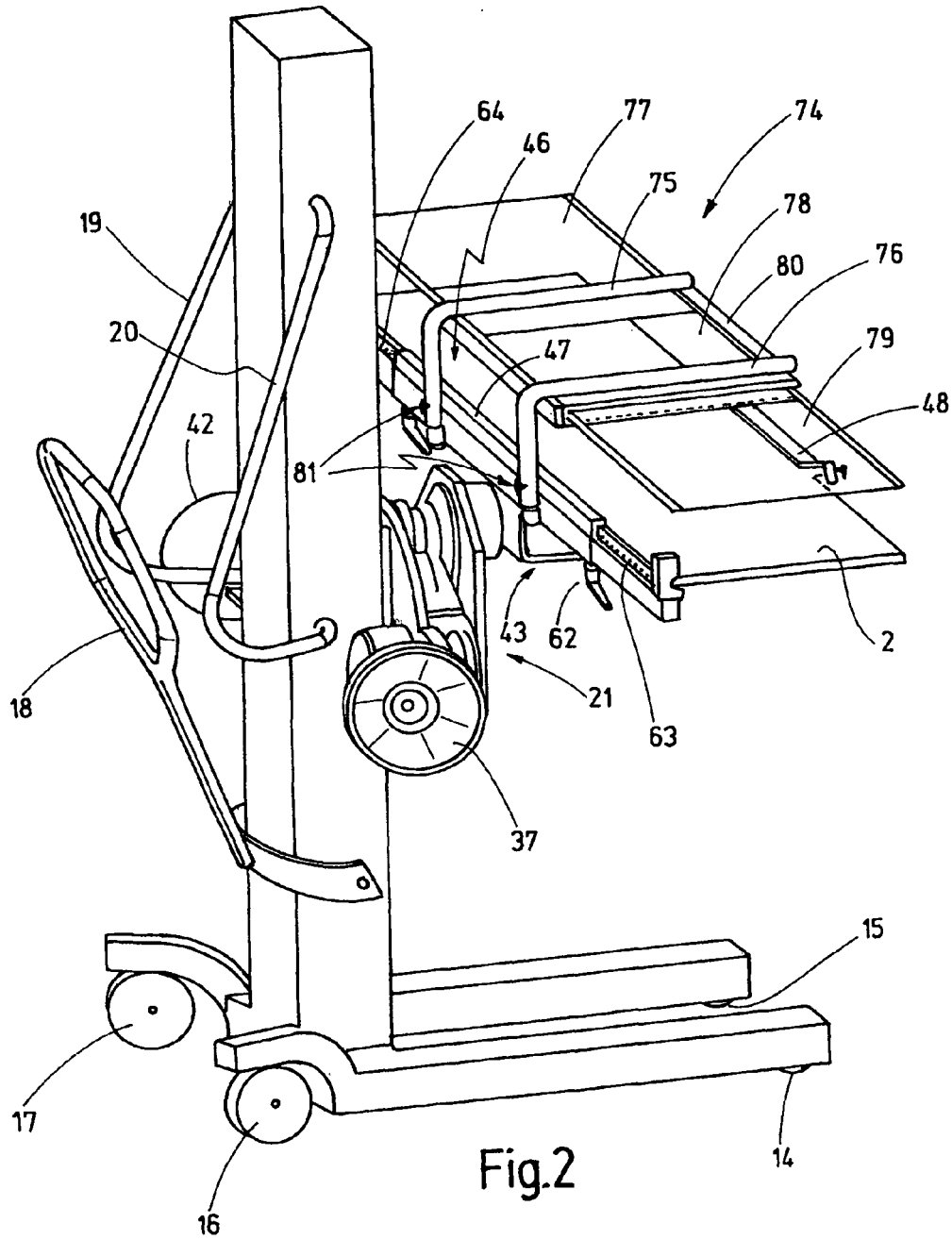
FIG. 2 is a perspective general view of the transport cart in accordance with FIG. 1, wherein the accommodation device of the cart is in a second horizontal position.
Figure 3:
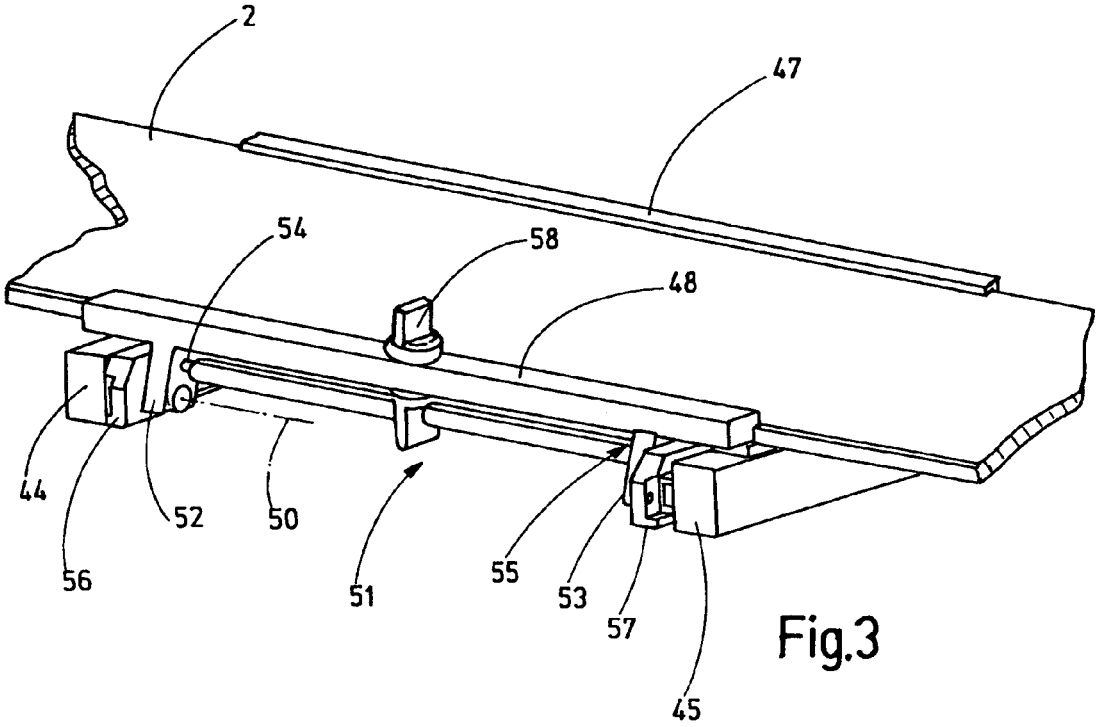
FIG. 3 is a perspective view of the accommodation device of the transport cart in accordance with FIG. 1, in the holding position.
Figure 4:
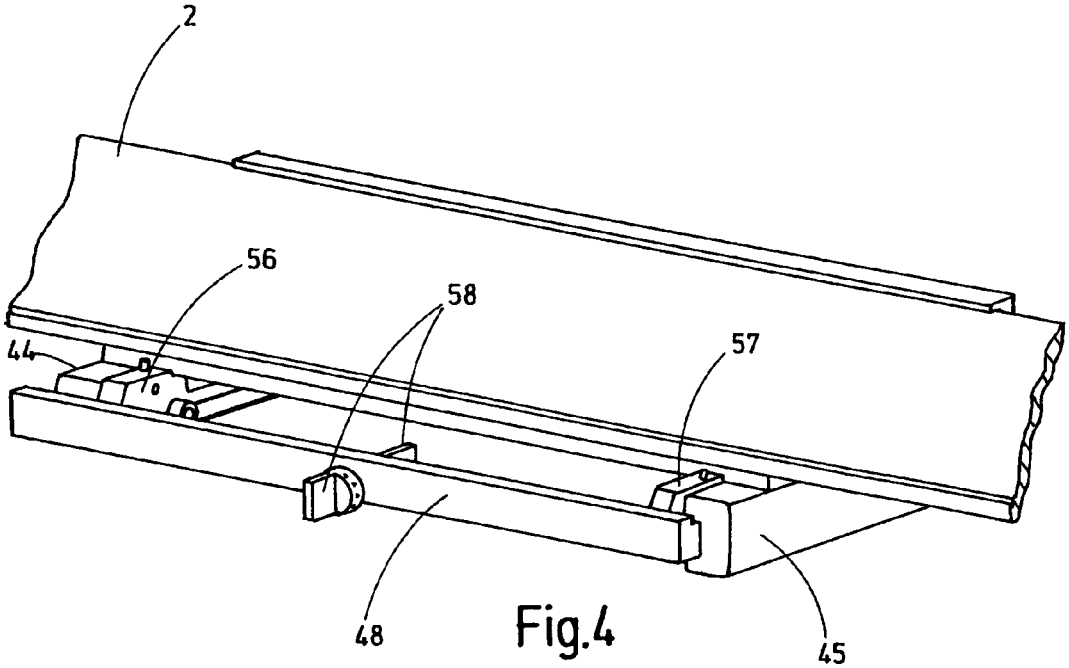
FIG. 4 is a perspective view of the accommodation device with the needle board in the release position.
Figure 5:
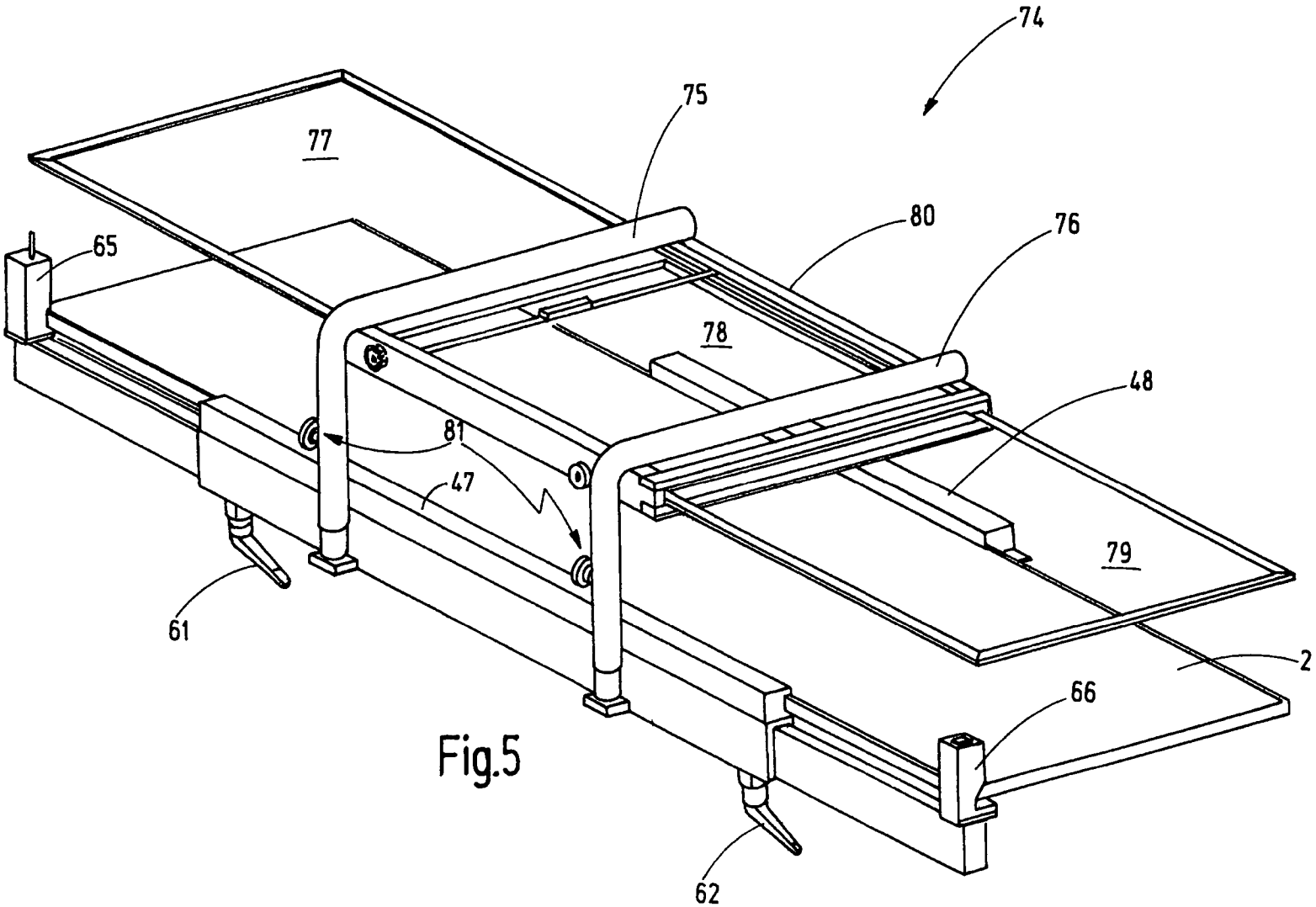
FIG. 5 is a separate perspective view of the accommodation device with protective cover and needle board.

In accordance with FIGS. 2 and 5 the protective cover 74 consists of three parts 77, 78, 79, whereby the parts 77 and 79 are identical in design. The protective cover 74 has transparent panes that are mounted in frames. The central part 78 is held in a frame 80. It has guide grooves, in which the parts 77, 79 are held so that they can be shifted. Not specifically illustrated clamping means are used to secure the parts 77, 79 in their respective pull-out position. Consequently, the length of the protective cover 74 can be adapted to the length of the needle board 2. Also, the distance between the protective cover 74 and the needle board 2 can be adjustable. To do so, the tubes 75, 76 may be seated on appropriate holders and fixed in place by means of clamping screws 81. Alternatively, appropriate engagement means may be provided instead of the clamping screws 81. The same applies regarding the fixation of the parts 77, 79 of the protective cover, whereby said parts may also by fixed in their respective pull-out positions by engagement means.

The transport cart 1 described so far works as follows:

The height of the transport cart 1 is first adjusted as needed. In so doing, the accommodation device 8 may be adjusted by hydraulic means or also by means of a screw spindle or by similar means. For example, the handle 18 may act as a pump lever that enables the lifting function. For lowering, a drain valve may be opened by means of a rotary knob. This knob may be resiliently supported so that, when the rotary knob is released, said knob automatically goes into locked position and the drain valve is closed.

If the needle board 2 is to be accommodated in horizontal position, in which the tips of the needles point upward, the frame 43 is rotated by actuating the hand wheels 37, 42 in a manner as shown in FIG. 2, i.e., the protective cover 74 is above the frame 43. The front profile rail 48 is pivoted into its release position in accordance with FIG. 4. The transport cart 1 is now moved in such a manner that the accommodation device 8 is positioned below the needle board 2 that is to be accommodated. Now the accommodation device 8 is lifted by means of the lifting function so that the needle board 2 is picked off its support location. It is now positioned on all the support surfaces of the accommodation device 8. Then the needle board 2 is manually positioned between the two stop units 65, 66. Optionally, the arms 59, 60 are adjusted to the needle board length. In so doing, the needle board 2 is fixed in place in its longitudinal direction. In addition, the needle board 2 is pushed into the recess of the rear profile rail 47. Thereafter, the front profile rail 48 is pivoted into its locked position in accordance with FIG. 3. Now the needle board 2 is fixed in position in each direction.

If the needle board is to be transported, it is pivoted out of its horizontal position and into its vertical position. This is accomplished by actuating the hand wheel 42. Because the gear drive is self-locking, the shaft 27 does not rotate while the hollow shaft 25 is rotated. As the needle board 2 is being pivoted out of its horizontal position and into its vertical position about the axis 22, the axis 23 is performing a tilting motion at the same time, because, in so doing, the cogged wheel 29 rolls off the stationary cogged wheel 28.

As a result of this, the center of gravity of the needle board is brought close to the column 11, whereby the required and desired stability of the transport cart 1 is achieved or aided.

If the needle board 2 is to be deposited, it is again pivoted into the horizontal position by reverse actuation of the hand wheel 42. The lock of the front profile rail 48 is opened. Then the needle board 2 that is positioned in the accommodation device 8 is positioned above the desired storage site. Thereafter, the needle board 2 is pushed slightly out of the U-shaped accommodation of the rear profile rail 47. Now the needle board 2 is lowered with the transport cart and is thus deposited at its storage site.

Figure 7A:
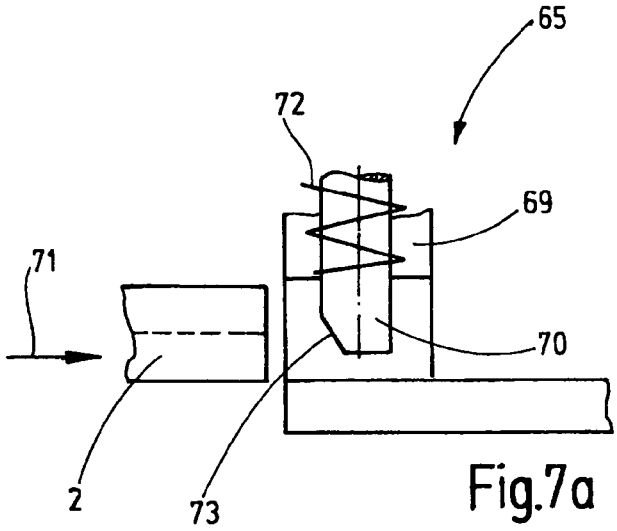
FIGS. 7*a* through 7*d* are a separate schematic illustration of an engagement device as locking means for the needle board, in various locking positions.
Figure 7B:
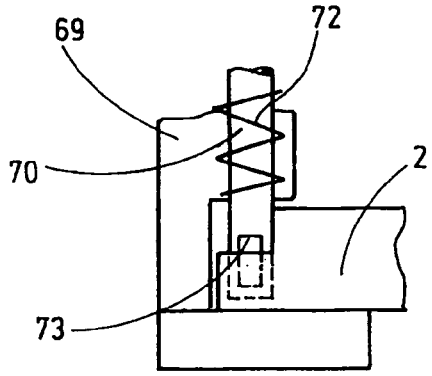
Figure 7C:
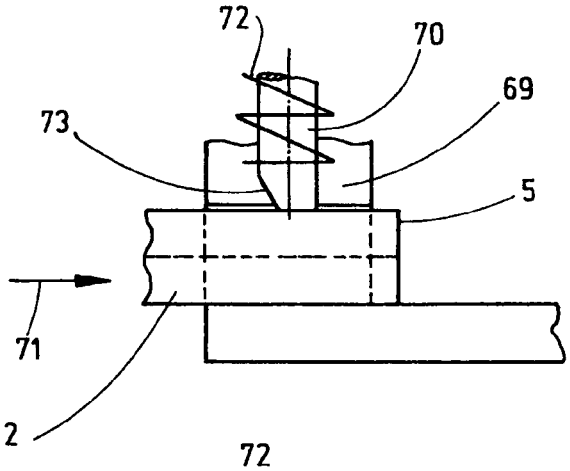
Figure 7D:
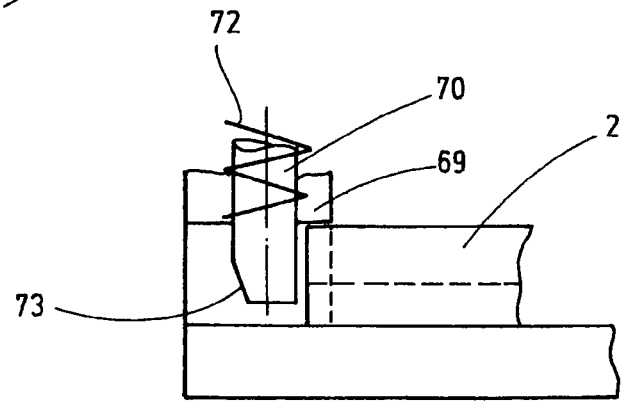

If the needle board 2 is to transferred from an automatic loader, the insertion movement of the needle board 2 does not occur—as described so far—in the direction of the axis 22 but, preferably, in the direction of the axis 23. To do so, the frame 43 is brought into the horizontal position. The profile rail 48 is in the locking position. The transport cart 1 is positioned next to the automatic loader in such a manner that the height and alignment of the needle board 2 in the automatic loader coincide with the accommodation device 8. The needle board 2 is positioned horizontally in the automatic loader. The needle tips point downward. The protective cover 74 is below the frame 43, as indicated by FIG. 1. Now, the needle board 2 is manually pushed into the accommodation device 8 of the transport cart 1. In so doing, the needle board 2 is pushed up to the stop unit 65 as shown by FIGS. 7*a* and 7*b*. The face of the needle board 2 on the edge 5 moves up against the inclined surface 73 and pushes aside the locking bolt 70, as shown by FIG. 7*c*. If the needle board 2 is pushed further, it finds the guide grooves of the profile rails 47, 48 and is pushed further until it abuts against the stop unit 66. The locking bolt 70 of the stop unit 65 now springs back into the locking position, as shown by FIG. 7*d*. The cylindrical surfaces of the two locking bolts 70 of the two stop units 65, 66 hold the needle board 2 locked between them. The needle board 2 is now held securely and can be moved away in this position or—after being pivoted into the vertical position—in its vertical position.

If the needle board 2 is to be deposited in the automatic loader, the accommodation device 8 is brought into the horizontal position in accordance with FIG. 1. In so doing, the transport cart 1 is positioned next to the automatic loader in such a manner that the height and alignment of the accommodation device of the transport cart 1 and the accommodation unit of the automatic loaders coincide. Now the locking bolt 70 of the stop unit 65 or 66 that is adjacent to the automatic loader is lifted by hand. Thereafter, the needle board 2 is pushed into the automatic loader, whereby the locking bolt 70 needs to be lifted only until its face can be seated on the edge of the needle board 2.

Needle boards may also be moved into or out of the transport cart 1 in positions or tilt positions that are different from the horizontal position. Such tilt positions can be selectively adjusted by actuating the hand wheel 37.

A transport cart 1 for needle boards 2 in accordance with the invention is provided with an accommodation device 8 that is designed so that its height can be adjusted and that it can also be pivoted about at least one axis, and that it is associated with a protective cover which can be moved together with the accommodation device. Numerous adjustment options, guide and stop devices are provided in order to be able to also handle large and heavy needle boards in a safe and careful manner.

It will be appreciated that the above description of the present invention is susceptible to various modifications, changes and modifications, and the same are intended to be comprehended within the meaning and range of equivalents of the appended claims.

REFERENCE NUMBERS

1 Transport cart
2 Needle board
3 Felting needles
4, 5 Short edges of the needle board
6, 7 Long edges of the needle board
8 Accommodation device
9 Base frame
10 Foot
11 Column
12, 13 Side rails
14, 15, 16, 17 Rollers, running wheels
18, 19, 20 Handle
21 Adjustment mechanism
22 First axis
23 Second axis
24 Support
25 Hollow shaft
26 Support member
27 Shaft
28, 29 Bevel gear
30 Shaft
31, 32 Arms
33, 34 Chain wheels
35 Chain
36 Gear drive
37 Actuation device, hand wheel
38, 39 Chain wheels
40 Chain
41 Gear drive
42 Actuation device, hand wheel
43 Frame
44, 45 Support arms
46 Accommodation element
47, 48 Profile rail
49 Locking means
50 Axis
51 Locking device
52, 53 Legs
54, 55 Lock pins
56, 57 Accommodation devices
58 Rotary knob
59, 60 Arms
61, 62 Clamping levers
63, 64 Scales
65, 66 Stop units
67, 68 Locking means
69 Guide body
70 Locking bolt
71 Insertion direction
72 Spring means
73 Inclined surface
74 Protective cover
75, 76 Tubes
77, 78, 79 Parts of the protective cover
80 Frame
81 Clamping screws

What is claimed is:

1. Transport cart for a needle board, comprising a base frame having running wheels, an accommodation device for the needle board supported on the base frame so as to be pivotable about first and second axes relative to the base frame, said accommodation device having an accommodation element adapted to the edge of the needle board and having at least one locking means for securing the needle board in the accommodation device; and wherein the accommodation device is associated with an actuation device that, by virtue of an actuation movement, effects a pivoting movement of the accommodation device about the first and second axes.

2. Transport cart in accordance with claim 1, wherein the accommodation device is additionally supported by the base frame so as to be adjustable in at least one direction (V).

3. Transport cart in accordance with claim 1, wherein the accommodation device has two profile rails arranged parallel to each other, said profile rails being disposed to grasp opposing long edges of the needle board.

4. Transport cart in accordance with claim 3, wherein the distance between the profile rails is adjustable.

5. Transport cart in accordance with claim 3, wherein one of the profile rails is supported so as to be pivotable between a holding position and a release position.

6. Transport cart in accordance with claim 1, wherein the locking means is a stop provided on a corner or on a short edge of the needle board.

7. Transport cart in accordance with claim 6, wherein the stop comprises a locking member that is supported so as to be movable between a locking position and a release position.

8. Transport cart in accordance with claim 7, wherein the locking member can be moved into the release position of said locking member by the needle board when coming in from outside the stop.

9. Transport cart for a needle board, comprising:

a base frame having running wheels, an accommodation device for the needle board supported on the base frame, said accommodation device having an accommodation element adapted to the edge of the needle board and having at least one locking means for securing the needle board in the accommodation device; and wherein the accommodation device has two profile rails arranged parallel to each other, with said profile rails being disposed to grasp opposing long edges of the needle board, and with the distance between the profile rails being adjustable.

10. Transport cart for a needle board, comprising:

a base frame having running wheels, an accommodation device for the needle board supported on the base frame, said accommodation device having an accommodation element adapted to the edge of the needle board and having at least one locking means for securing the needle board in the accommodation device; and wherein the accommodation device has two profile rails arranged parallel to each other, with said profile rails being disposed to grasp opposing long edges of the needle board, and with one of the profile rails being supported so as to be pivotable between a holding position and a release position.

* * * * *